United States Patent [19]

Musschoot

[11] 4,357,760

[45] * Nov. 9, 1982

[54] APPARATUS FOR DRYING PULVERULENT MATERIAL

[75] Inventor: Albert Musschoot, Barrington, Ill.

[73] Assignee: General Kinematics Corporation, Barrington, Ill.

[ * ] Notice: The portion of the term of this patent subsequent to Feb. 24, 1998, has been disclaimed.

[21] Appl. No.: 230,854

[22] Filed: Feb. 2, 1981

[51] Int. Cl.[3] ..... F26B 25/04

[52] U.S. Cl. ..... 34/56; 34/92; 34/147; 34/164

[58] Field of Search ..... 34/91, 164, 56, 147

[56] References Cited

U.S. PATENT DOCUMENTS

| | | | |
|---|---|---|---|
| 2,621,492 | 12/1952 | Beardsley et al. | 34/15 |
| 3,733,716 | 5/1973 | Bonteil | 34/164 |
| 3,742,614 | 7/1973 | Bettermann et al. | 34/164 |
| 3,868,213 | 2/1975 | Shulika et al. | 34/164 |
| 4,264,415 | 4/1981 | Galow et al. | 34/174 |

*Primary Examiner*—Larry I. Schwartz

*Attorney, Agent, or Firm*—Wegner, McCord, Wood & Dalton

[57] ABSTRACT

Apparatus is provided for drying pulverulent material, for example, coal slurry wherein the slurry, after preliminary drying, is introduced into a vibrating chamber carrying internal flights and subjected to vacuum to remove moisture. A pair of such containers may be provided so that slurry may alternately be introduced into one container while the other container is vibrating under vacuum so as to provide a continuous drying method.

5 Claims, 3 Drawing Figures

41
44
42
16
11
12
43
14
15
34
36
45
25
37
38
28
24
17

APPARATUS FOR DRYING PULVERULENT MATERIAL

BACKGROUND OF THE INVENTION

In many industrial processes it becomes necessary as part of the process to remove water from granular or pulverulent material. Heretofore, heat has been used as the primary drying medium, either in the form of hot air passed through the material or by simply heating the material in a vessel through the use of coils or other means of transferring heat. Such methods are expensive and consume a great deal of energy in the process.

SUMMARY OF THE PRESENT INVENTION

The present invention utilizes vacuum applied to a closed vibrating chamber to effect extraction of moisture from the material. The apparatus of the present invention is particularly useful in removing moisture from coal slurry in order to render it usable as a fuel. Coal can be transported over large distances by means of a pipeline. The coal is reduced to particulate size and mixed with water to form a slurry and the slurry may then be pumped over hundreds of miles for ultimate use. After arriving at its destination, the slurry must be dried from a moisture content of something on the order of 50% to approximately 9% moisture content in order to be usable as a fuel. Preliminary drying can be accomplished with the use of centrifuges which reduces the water content down to approximately 13–15%. The slurry then at that water content is introduced into the vibrating vacuum chambers which will reduce the moisture content to approximately 9% producing a usable fuel.

DESCRIPTION OF THE PREFERRED EMBODIMENT

Figure 1:
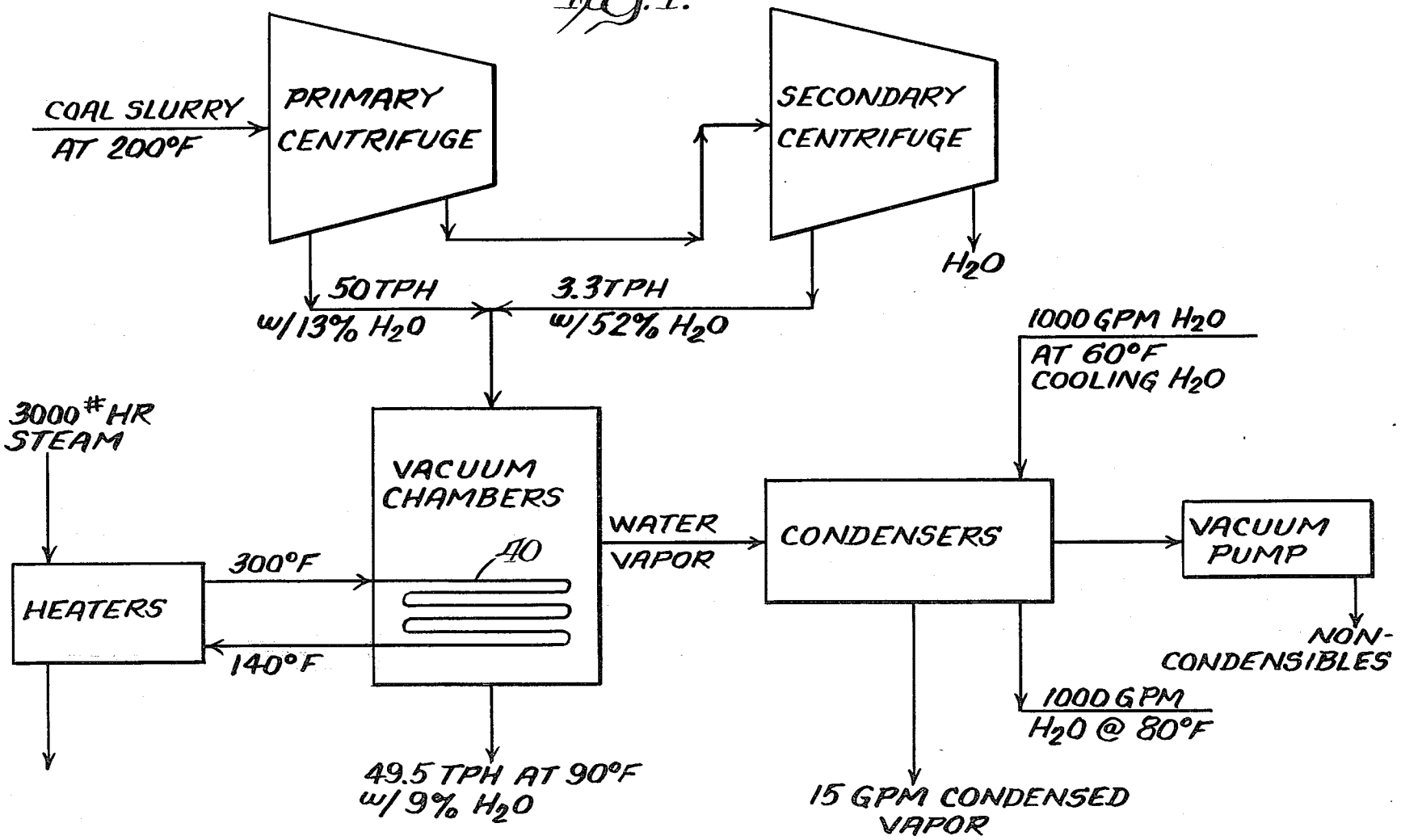
FIG. 1 is a flow sheet diagrammatically illustrating the steps of the process.

The general arrangement of the apparatus and process is diagrammatically illustrated in FIG. 1 of the drawings. Coal slurry at a temperature of approximately 200° F. and a moisture content of 50% exiting from the pipeline is introduced into a primary centrifuge which reduces the moisture content to approximately 13%. In the particular system chosen for illustration, approximately 50 tons per hour are discharged from the primary centrifuge. Slurry with a high liquid content discharged from the primary centrifuge is introduced into a secondary centrifuge which discharges approximately 3.3 tons per hour with a moisture content of approximately 52%. From the centrifuges the slurry is introduced into vacuum chambers which are vibrated generally vertically and which may be provided with a source of auxiliary heat such as the coils 40. As indicated in the drawings, the coils are supplied with heated fluid, preferably ethylene glycol, heated to approximately 300° F. by steam and introduced through a flexible connection into the coils 40. The glycol will exit from the coils at approximately 140° F. to be returned to the heaters for heating. The slurry in the vibrating vacuum chambers is subjected to vacuum by being connected to a condenser supplied with cooling water, the condensible vapors exiting from the condenser and the noncondensible vapors being withdrawn by a vacuum pump. When connected to the condensers, the vacuum chambers are drawn down to a pressure of something of the order of less than 5 psi absolute. When the drying is complete, the chamber is disconnected from the condenser and the dried coal exits from the bottom of the vacuum chambers at about 9% moisture content.

As noted above the slurry is introduced into the system at about 200° F. and normally exits from the vacuum chamber at about 90° F. Normally, the slurry retains sufficient heat so as to expedite the drying process in the vacuum chamber but, as noted, auxiliary heat may be supplied through the coil system should it be desired.

Figure 2:
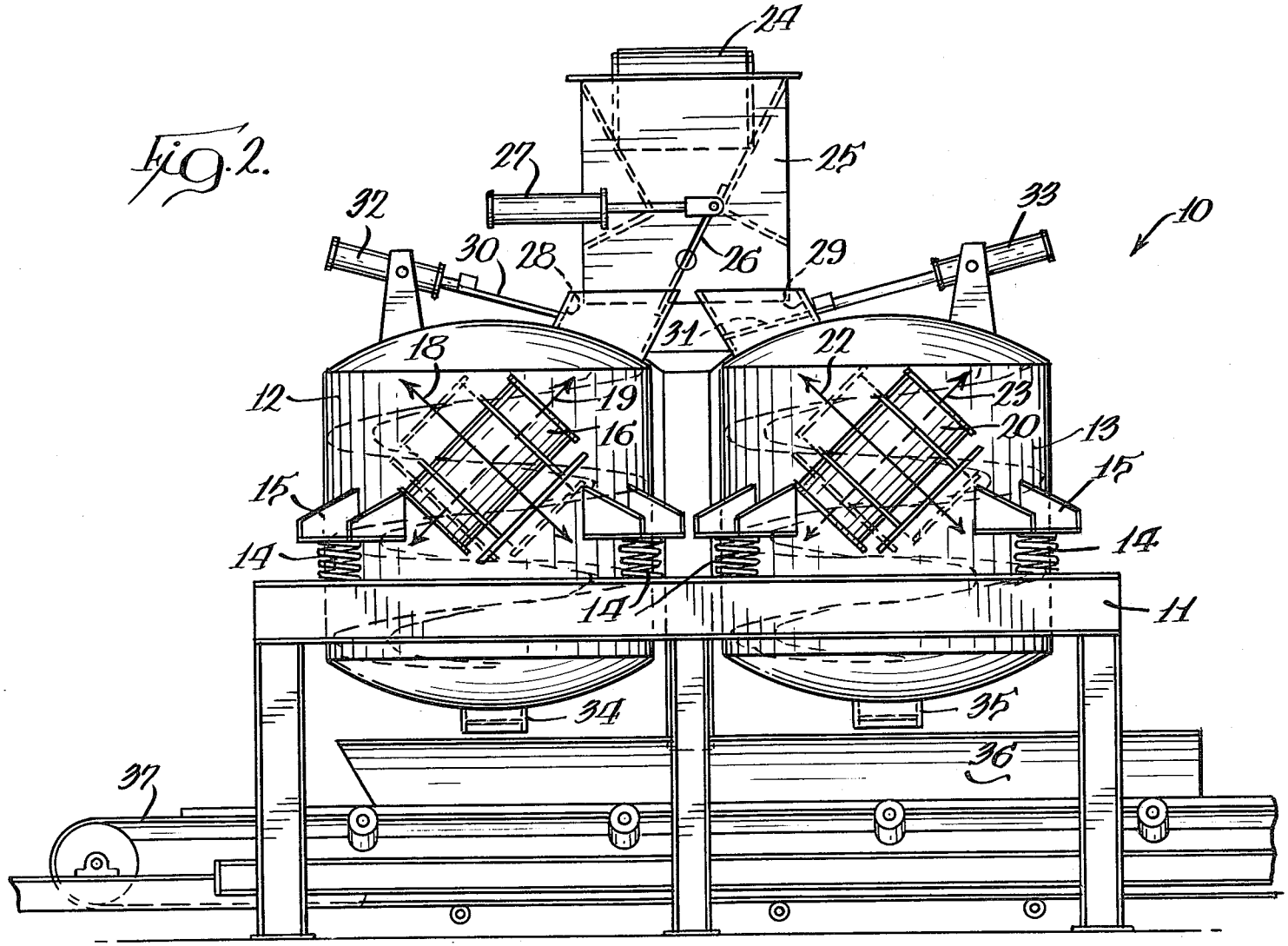
FIG. 2 is a side elevational view of a pair of containers mounted for vibratory movement.

Referring to FIG. 2 of the drawings for a more detailed description of the specific apparatus downstream of the centrifuges generally indicated as 10, there is shown a base 11 mounted on the floor or other suitable foundation, a pair of containers 12 and 13 mounted on springs 14 which extend between the base 11 and brackets 15 secured to each of the containers. The container 12 has secured thereto on opposite sides thereof a pair of electric motors 16 and 17 each inclined to the vertical, with the shaft of each motor carrying an eccentric weight at each end. The arrangement is such that the motor 16 imparts vibratory movement to the container along the line indicated by the arrow 18 while the motor 17 on the opposite side of the container imparts vibratory movement along the line indicated by the arrow 19. The vibratory motion thus created is along the line of a vertical spiral path.

Two similar motors are secured to opposite sides of the container 13, one of such motors being indicated at 20 with the vibratory movement imparted by the motor 20 being indicated by the arrow 22 and the direction of vibratory movement of the electric motor on the opposite side being indicated by the arrow 23. Thus, vertical vibration along a spiral path is also imparted to the container 13.

Located above the containers is a belt conveyor 24 which carries slurry from the discharge of the centrifuges. to a chute 25 positioned above the containers. A flap valve 26 directs the slurry either into the container 12 or the container 13 depending upon the position of the valve. The flap valve is controlled by a piston and cylinder device 27.

With the valve 26 in the position shown, slurry entering the chute 25 is directed through an opening 28 into the container 12. At that time, the opening 29 into the container 13 is closed by a valve 31 which seals off the container 13 from the atmosphere. A similar valve 30 controls the opening 28 with the valve 30 being operated by the piston and cylinder device 32 and the valve 31 being operated by the piston and cylinder device 33.

Each of the containers is provided at its bottom with a discharge opening 34 and 35 which are positioned above a receiving trough having sides 36. The bottom of the trough is formed by a belt conveyor 37 for removing the coal discharged from the containers.

Figure 3:
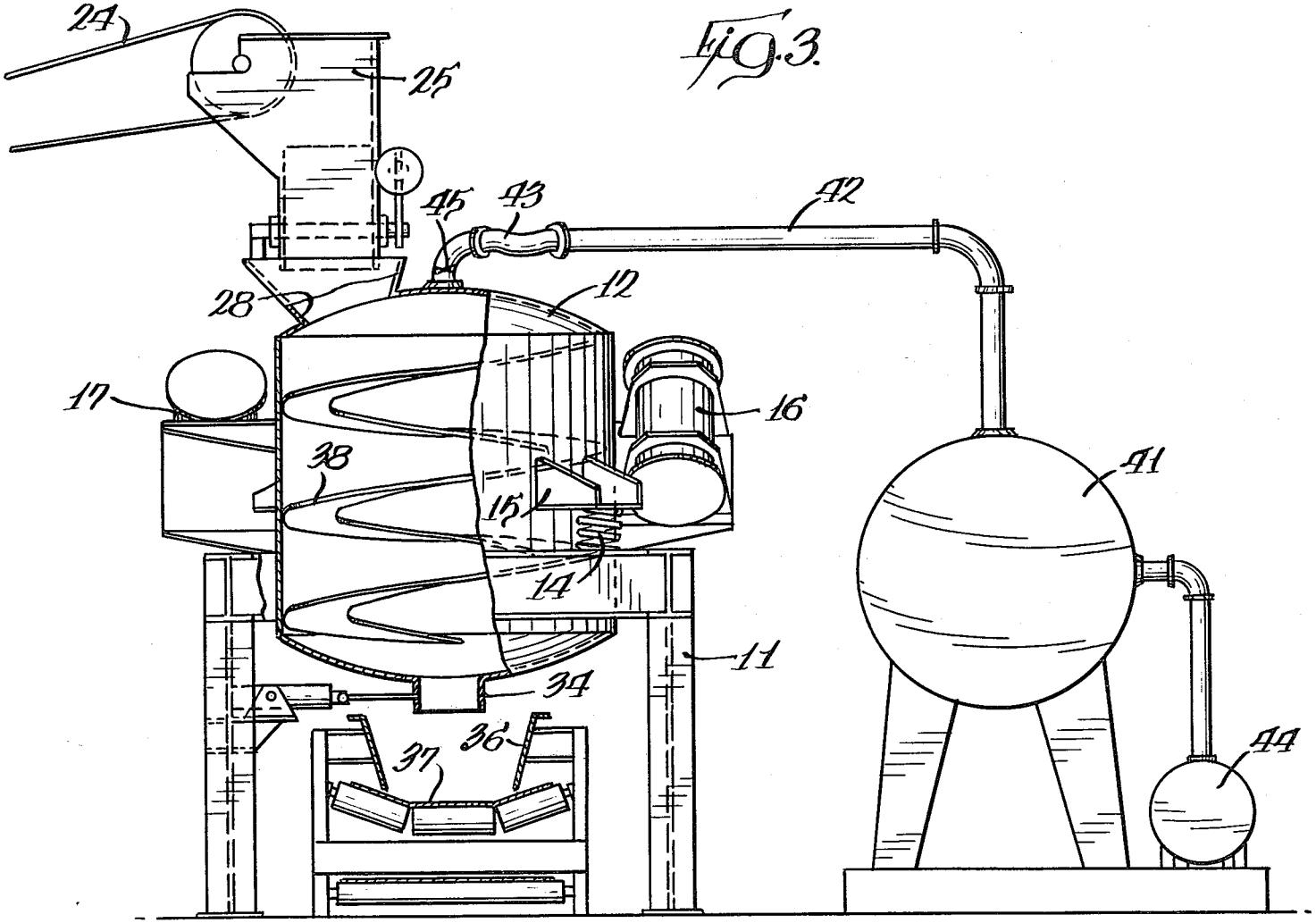
FIG. 3 is a side elevational view partially broken away for clarity of illustration showing details of one of the containers.

Reffering to FIG. 3 of the drawings, there is shown a spiral flight 38, one of which is found in each of the containers with the flight being secured to the interior sidewalls of the container and spiraling upwardly from the bottom toward the top. The spiral generally parallels the spiral path of vibratory movement imparted by the electric motor and their eccentric weights hereinbefore described.

The heating coils 40 are not shown in FIG. 3 in order that a more detailed view of the interior of the container can be had. Such coils can be included within the container as indicated in FIG. 1 where it is felt that auxiliary heat may be necessary or desirable. Again, a flexible connection (to permit of the vibration) will be provided between the coils within the container and the heater supplying the heated fluid.

Each of the containers 12 and 13 is connected to a condensing chamber 41 by conduit 42 and flexible connection 43. A vacuum pump 44 together with the cooling coils in the condenser maintain the pressure in the condensing chamber at or below 5 psi absolute. A valve indicated at 45 is provided in the conduit 42 to close off connection between the interior of the container 12 and the condensing chamber 41 when coal slurry is being introduced into the container. The valve 45 is opened after valve 30 is closed so as to reduce the pressure in the container to below 5 psi absolute during the vibration to effect the drying.

While the apparatus has been shown and described as used to dry coal slurry, the system is also applicable and useful to dry other pulverulent materials with a minimum of energy and space.

I claim:

1. Apparatus for drying wet pulverulent material comprising a source of the material, a pair of containers, a base, a plurality of isolation springs supporting the containers on said base, each container having means for imparting spiral vertical vibratory movement thereto including a pair of electric motors one on each side of each container, each motor having a shaft carrying a pair of eccentric weights with the axes of said shafts being oppositely inclined to the veritcal, means selectively operable to direct the flow of material from the source to one or the other of said containers, an outlet from each container, valve means controlling said outlets, a source of vacuum, means selectively operable to connect the source of vacuum to one or the other of said containers, a control mechanism for controlling said flow directing means and said valve means, said control means being arranged sequentially to direct flow of material into one container then connecting said one container to the source of vacuum while directing flow of material into the other container, then operating the valve means to discharge material from said first container and then connecting the source of vacuum to the other container and directing flow of material into the first container.

2. Apparatus for drying wet pulverulent material comprising a source of the material, a pair of containers, a base, a plurality of isolation springs supporting the containers in vertical array on said base, each container having means for imparting spiral vertical vibratory movement thereto including a pair of electric motors one on each side of each container, each motor having a shaft carrying a pair of eccentric weights with the axes of said shafts being oppositely inclined to the vertical, a flight in each container spiralling upwardly from near the bottom to near the top of each container in the same spiral direction as the spiral vibratory movement, means selectively operable to direct the flow of material from the source to one or the other of said containers, an outlet from each container, valve means controlling said outlets, a source of vacuum, means selectively operable to connect the source of vacuum to one or the other of said containers, a control mechanism for controlling said flow directing means and said valve means, said control means being arranged sequentially to direct flow of material into one container then connecting said one container to the source of vacuum while directing flow of material into the other container, then operating the valve means to discharge material from said first container and then connecting the source of vacuum to the other container and directing flow of material into the first container.

3. Apparatus for drying wet pulverulent material comprising a source of the material, a pair of containers, a base, a plurality of isolation springs supporting the containers in veritcal array on said base, a heating coil in each container, a source of heat connected to said coils, each container having means for imparting spiral vertical vibratory movement thereto including a pair of electric motors one on each side of each container, each motor having a shaft carrying a pair of eccentric weights with the axes of said shafts being oppositely inclined to the vertical, a flight in each container spiralling upwardly from near the bottom to near the top of each container in the same spiral direction as the spiral vibratory movement, means selectively operable to direct the flow of material from the source to one or the other of said containers, an outlet from each container, valve means controlling said outlets, a source of vacuum, means selectively operable to connect the source of vacuum to one or the other of said containers, a control mechanism for controlling said flow directing means and said valve means, said control means being arranged sequentially to direct flow of material into one container then connecting said one container to the source of vacuum while directing flow of material into the other container then operating the valve means to discharge material from said first container and then connecting the source of vacuum to the other container and directing flow of material into the first container.

4. Apparatus for drying wet pulverulent material comprising source of the material, a container, a base, a plurality of isolation springs supporting the container on said base, said container having means for imparting spiral vertical vibratory movement thereto including a pair of electric motors one on each side of the container, each motor having a shaft carrying a pair of eccentric weights with the axes of said shafts being oppositely inclined to the vertical, an outlet from the container, valve means controlling said outlet, a source of vacuum, and means selectively operable to connect and disconnect the source of vacuum to said container.

5. Apparatus for drying wet pulverulent material comprising a source of the material, a container, a base, a plurality of isolation springs supporting the container in vertical array on said base, a heating coil in the container, a source of heat connected to said coil, said container having means for imparting spiral vertical vibratory movement thereto including a pair of electric motors one on each side of said container, each motor having a shaft carrying a pair of eccentric weights with the axes of said shafts being oppositely inclined to the veritcal, a flight in said container spiralling upwardly from near the bottom to near the top of said container in the same spiral direction as the spiral vibratory movement, means operable to direct the flow of material from the source to said container, an outlet from the container, valve means controlling said outlet, a source of vacuum, means selectively operable to connect and disconnect the source of vacuum to said container, a control mechanism for controlling said flow directing means and said valve means, said control means being arranged sequentially to direct flow of material into said container then connecting said container to the source of vacuum, then operating the valve means to discharge material from said container and then directing flow of material into the container.

* * * * *